United States Patent [19]

Mosier

[11] Patent Number: 4,944,703

[45] Date of Patent: Jul. 31, 1990

[54] SWIM FIN HAVING MULTIPLE ARTICULATING TRANSVERSE HYDROFOIL BLADES

[76] Inventor: Arthur R. Mosier, 10922 Oak St., No. 216, Los Alamitos, Calif. 90720

[21] Appl. No.: 180,155

[22] Filed: Apr. 11, 1988

[51] Int. Cl.[5] ..... A63C 31/10

[52] U.S. Cl. ..... 441/62; 441/61

[58] Field of Search ..... 440/14; 441/61–64; 416/72

[56] References Cited

U.S. PATENT DOCUMENTS 3,081,467 3/1963 Ciccotelli ..... 441/63
3,665,535 5/1972 Picken ..... 441/64
3,952,351 4/1976 Gisbert ..... 441/64
4,178,128 12/1979 Gongwer ..... 441/62

*Primary Examiner*—Sherman D. Basinger
*Assistant Examiner*—Edwin L. Swinehart
*Attorney, Agent, or Firm*—Roy A. Ekstrand

[57] ABSTRACT

A swim fin includes a foot receptacle for attaching to a swimmer or diver's foot. A pair of parallel beam supports are secured to the foot and toe portion of the foot receptacle and support a plurality of hydrofoil blades therebetween in a pivotal attachment. Limits are provided to restrict the pivotal motion of the hydrofoil blades to provide an optimum angle of attack for the hydrofoil blades during the swimming stroke.

6 Claims, 3 Drawing Sheets

SWIM FIN HAVING MULTIPLE ARTICULATING TRANSVERSE HYDROFOIL BLADES

FIELD OF THE INVENTION

This invention relates generally to swimming aid devices and particularly to swim fins adapted for use on the feet of swimmers and divers.

BACKGROUND OF THE INVENTION

For many years, swimmers and divers have attempted to use various devices to improve the power and speed with which a human can move through the water. A great deal of attention has been directed to devices which are adapted to provide an improved power transmitting device for use on the feet of swimmers or divers. There is a recognition that the typical foot of a swimmer or diver represents a relatively small interactive service are for coupling power to the water and propelling the swimmer or diver. The majority of such devices, particularly the early devices, generally comprised structures and shapes adapted to imitate the appendages of aquatic animals. Such devices are generally referred to as swim fins and provide a broad relatively flexible fin portion having means for securing the fin to the swimmer or diver's foot.

While the human leg and foot strokes differ somewhat, it has been found preferable to employ a leg action in which the ankle and knee joint are maintained in a relatively fixed position while the entire leg is pivoted or rotated about the hip joint through a circular segment of travel. With conventional swim fins of the type described above, the leg action moves the fin through the water causing it to flex somewhat and produce a pressure wave which is directed in the direction generally opposite to the direction of travel. This action is known as "sculling" and while the pressure wave results in a generally forward reaction force upon the swimmer or diver and forward propulsion through the water, it requires a great deal of energy to move the conventional swim fin through the water. The need for such substantial energy is caused by the high drag resistance of the water moving about the fin to replace the water displaced by the fin movement. As a result, a very small portion of the total energy required to move the conventional swim fin through the water is actually converted into a propelling thrust.

Because divers, particularly those using underwater breathing devices popularly called scuba divers, often rely exclusively upon leg action to propel them beneath the water, the high energy requirements for leg action with conventional swim fins and inefficiency of the fin action has created a need in the art for improved swim fin devices. Recognizing this need, practitioners in the art have employed a variety of structures directed at improving the efficiency and effectiveness of such swim fins.

Several structures have been created which utilize various arrangements of vent apertures or passages through the fin blade with the object of allowing the flow of water from the high pressure side of the fin to the low pressure side to reduce swimming effort.

U.S. Pat. No. Des. 280,782 issued to Hill sets forth a SWIM FIN in which a foot receptacle is coupled to a flexible blade and a plurality of vent apertures are located between the foot receptacle and the proximate end of the blade portion.

U.S. Pat. No. 3,183,529 issued to Beuchat sets forth a SWIMMER'S FOOT-FIN WITH THRUST ACCELERATING DEVICE in which a hollow foot portion adapted to receive a swimmer's foot supports an extending blade therefrom. The blade is formed of a resilient flexible material and includes a plurality of transversely spaced longitudinal ribs and a plurality of longitudinal channels extending between the upper and lower sides of the fin.

U.S. Pat. No. 3,649,979 issued to MacNiel sets forth a SWIM FIN having a foot receiving portion and a flexible blade extending therefrom. A water intake or scoop formed in the upper portion of the fin is coupled to an exhaust opening at the lower end of the fin portion by a passage such that water is caused to flow in through the scoop portion through the passage and out through the exhaust opening during the stroking action.

While such devices provide some improvement in reduction of swimming effort, they do not increase the swimming efficiency of the swim fin.

In addition to the foregoing described devices, a number of devices have been created which are directed at reducing the stress imposed upon the swimmer's ankle which otherwise arises from the use of a conventional swim fin. While the structure of these devices varies somewhat, their general operative function is to couple the force between the swim fin and the swimmer's leg directly rather than through the swimmer's ankle.

U.S. Pat. No. 3,978,587 issued to Shamlian sets forth a SWIM FIN INCLUDING MEANS FOR MAINTAINING FOOT AND LEG IN FIXED RELATIONSHIP sets forth a foot mounted swim fin adapted for fitting to the swimmer's legs having a foot receiving portion and a blade extending forwardly therefrom. The foot receiving portion includes an attachment extending rigidly therefrom at a predetermined fixed angle which when worn by the swimmer provides a fixed angle brace portion between the swimmer's foot and the swimmer's leg.

U.S. Pat. No. 4,017,925 issued to Shamlian sets forth a SWIM FIN INCLUDING MEANS FOR RESTRICTING ANKLE MOVEMENT in which a swim fin having a foot pocket and an outwardly extending fin member includes a leg cuff adapted to be fitted to the lower portion of the swimmer's leg. A rigid couplinq extends from the foot portion to the leg cuff and provides a fixed constraint of ankle movement by the swimmer.

While such ankle supporting devices permit an increased force to be applied to the fin without overly stressing the swimmer's ankle, such increased force has been found to simply increase the velocity of the swim fin through the after which in turn increases the drag or resistive force of the water upon the swim fin with the result that swimming efficiency is not significantly improved.

Several swim fin structures have been provided which generate forward propulsion or thrust through a planing action as opposed to the pressure wave action of the foregoing described types of swim fins. The primary departure of such structures from the prior swim fins is the provision of an articulating plane member which is pivotally mounted within a supporting frame which in turn is secured to the swimmer's foot.

U.S. Pat. No. 3,665,535 issued to Picken sets forth a SWIM FIN having a foot receptacle and an extending support coupled to the toe portion thereof. The extending support in turn supports a pivotally articulated blade member having a generally planar configuration. Means are provided for limiting the pivotal motion of the blade to a predetermined range of angular movement In an alternate embodiment a flexible frame is used which undergoes angular rotation about the top portion of the foot receptacle during the swimming stroke.

U.S. Pat. No. 4,209,866 issued to Loeffler sets forth a SWIM FIN in which a blade portion having a generally planar configuration is pivotally mounted to a foot section along a pivot line intermediate the leading and trailing edges. The blade is spaced from the foot portion to create a flow passage between the toe portion of the foot portion and the blade. A resilient link is coupled between the leading edge of the blade and the toe portion to restrict the angular motion of the blade.

Such swim fins avoid a substantial portion of the inherent drag provided by the above-described swim fin designs. However, the efficiency of the fin remains limited.

While several of the foregoing described swim fin structures provide some increase in swim fin efficiency and have to some extent improved swim fin design, there remains a need in the art for a further improved swim fin construction which significantly reduces the resistance of the swim fin to movement through the water while providing a higher efficiency in converting the force applied by the swimmer's leg into a forward thrust or propelling force.

SUMMARY OF THE INVENTION

Accordingly, it is a general object of the present invention to provide an improved swim fin. It is a more particular object of the present invention to provide an improved swim fin which requires substantially less force or energy to be moved through the water during stroking. It is a still more particular object of the present invention to provide an improved swim fin which requires substantially less force to be moved through the water while producing an increased and more efficient conversion of the leg action force into a forward thrust.

In accordance with the present invention, there is provided a swim fin having a foot receptacle and means for securing the foot receptacle to a swimmer's foot together with a blade support structure extending outwardly from the foot receptacle and a plurality of pivotally supported articulated transverse hydrofoil blades coupled to the support structure.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

Figures 1, 2A, 2B, 2C, 3:
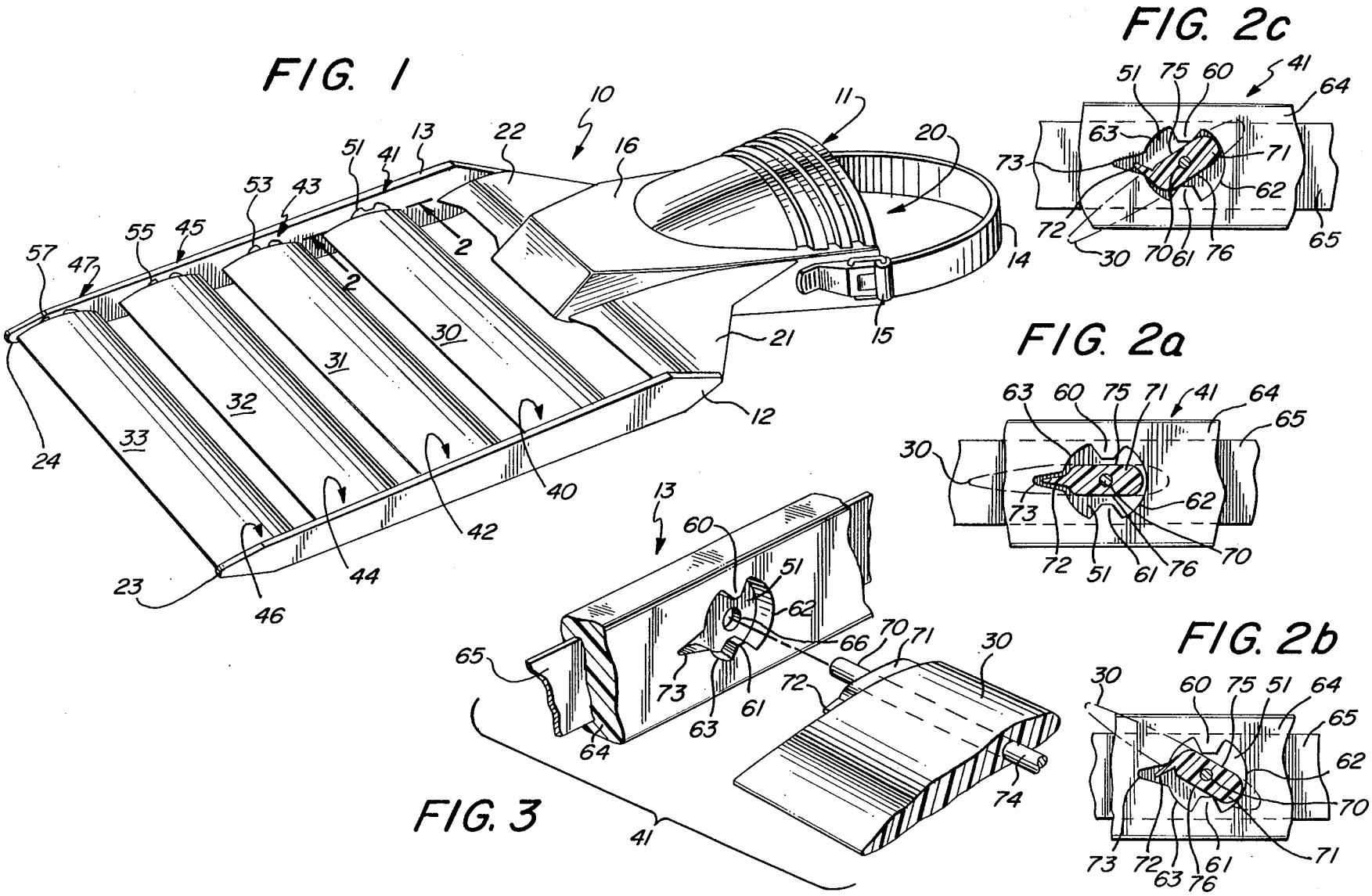
FIG. 1 is a top perspective view of a swim fin constructed in accordance with the present invention.
Figure 4:
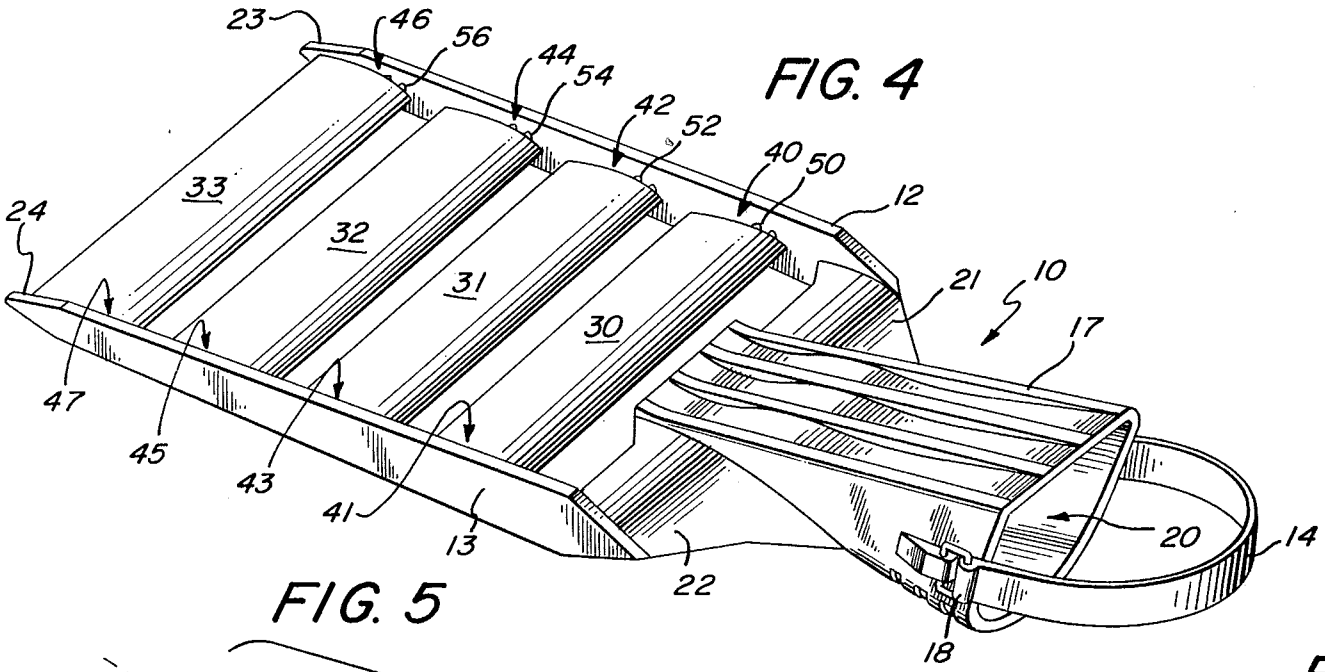
Figure 6:
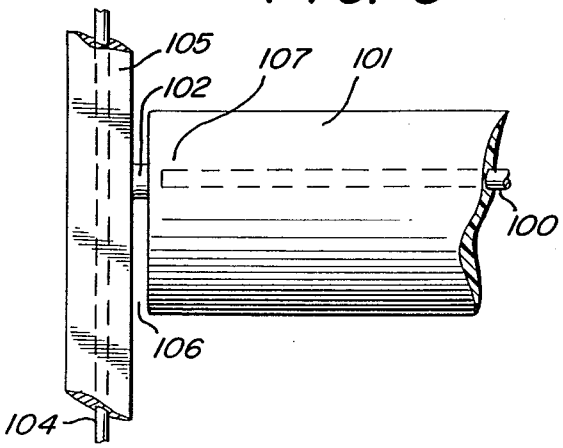
Figure 5:
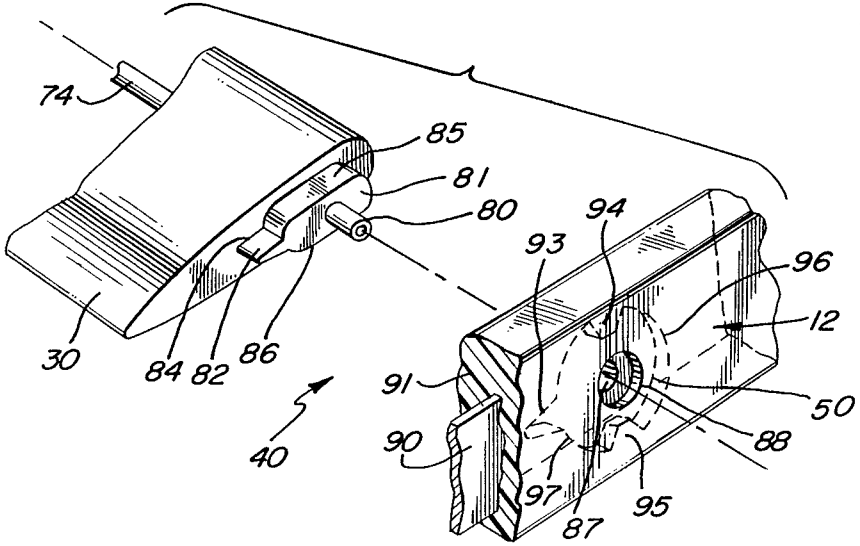
Figure 7A:
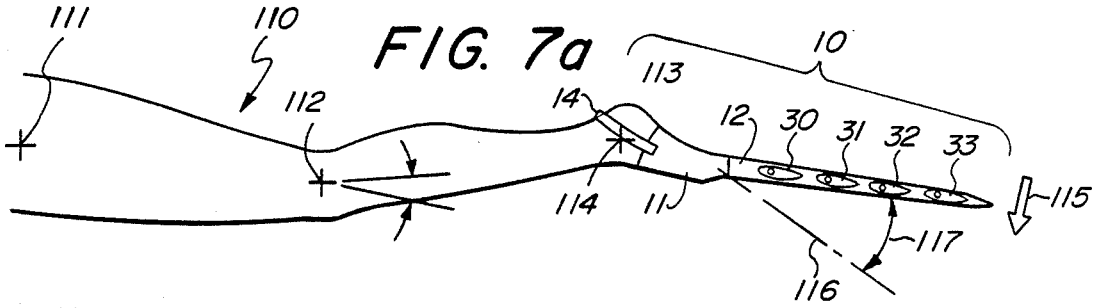
Figure 7B:
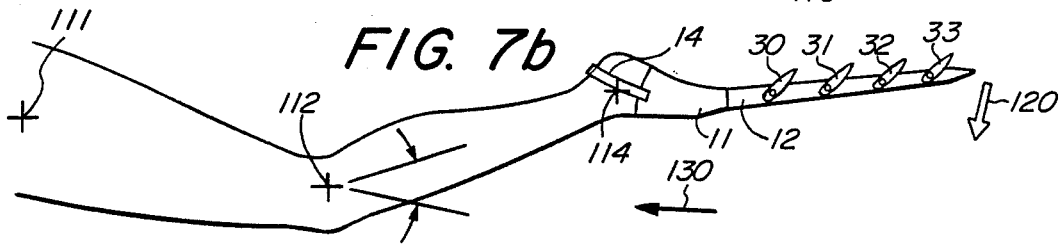
Figure 7C:
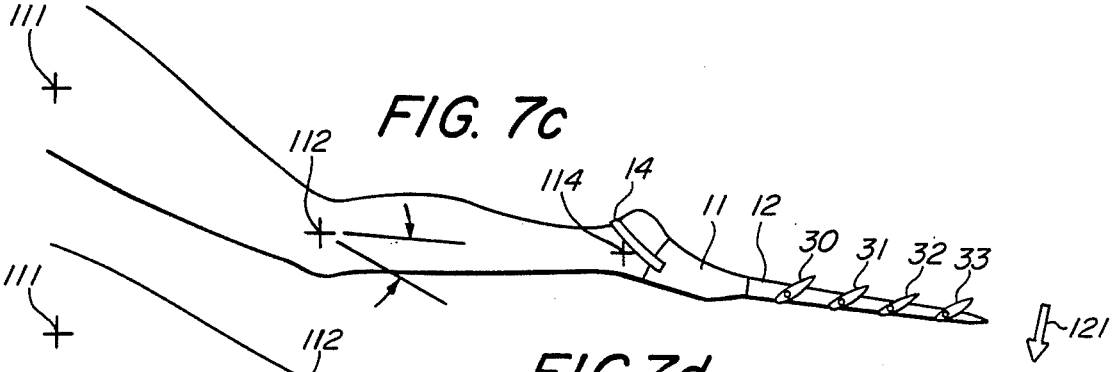
Figure 7D:
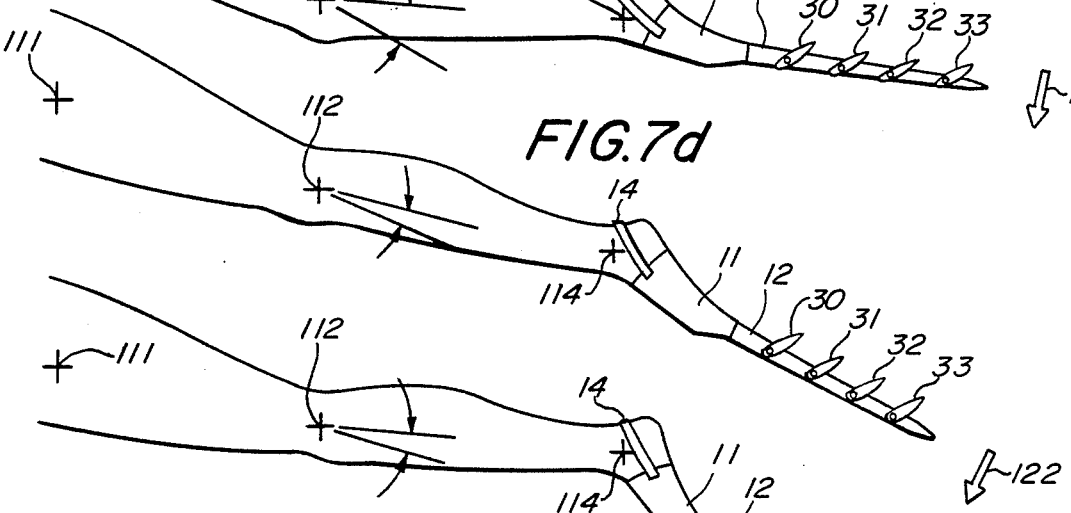
Figure 7E:
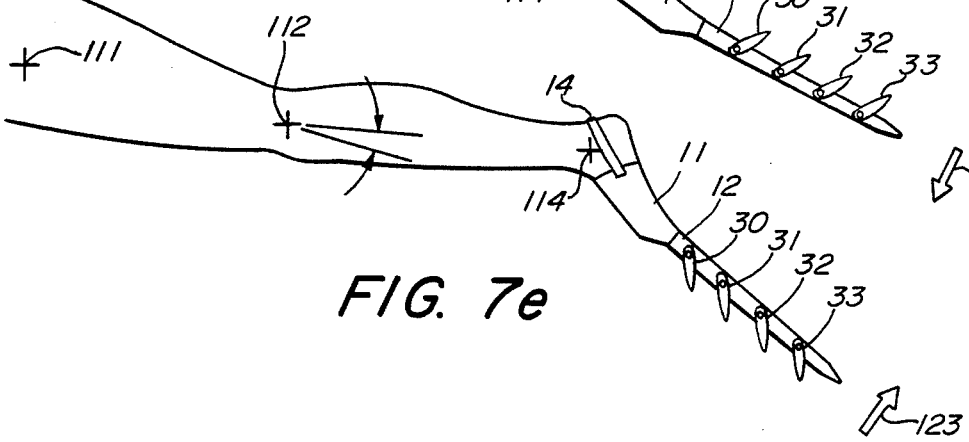

FIGS. *2a*, *2b* and *2c* are partial section views of the pivotal blade support portion of the present invention swim fin showing sequential views of hydrofoil blade pivoting action;

FIG. 3 is a partial section perspective view of a typical pivotal attachment of a blade constructed in accordance with the present invention;

FIG. 4 is a bottom perspective view of the present invention swim fin;

FIG. 5 is a partial section perspective view of a typical blade attachment for the present invention swim fin;

FIG. 6 is a partial section top plan view of an alternate embodiment blade attachment of the present invention swim fin; and FIGS. *7a* through *7e* set forth sequential pictorial depictions of the blade motions of the present invention swim fin during a typical swimming stroke.

DESCRIPTION OF THE PREFERRED EMBODIMENTS

FIG. 1 sets forth a perspective view of a swim fin 10 constructed in accordance with the present invention. A foot receptacle 11 defines an interior cavity 20 (better seen in FIG. 4), a surrounding strap 14 and a buckle mechanism 15. Foot receptacle 11 further defines a toe portion 16 and a pair of outwardly extending lateral supports 21 and 22. A pair of elongated beam supports 12 and 18 are joined to and extend outwardly from lateral supports 21 and 22 respectively and terminate in tapered end portions 28 and 24 respectively. In accordance with the preferred structure of the present invention, beam supports 12 and 13 are generally parallel and define therebetween a uniform space. A plurality of hydrofoil blades 30, 31, 32 and 33 are by means set forth below in greater detail pivotally secured between beam supports 12 and 13 by a plurality of blade attachments 40 through 47. Hydrofoil blade 30 is secured by a blade attachment 40 to beam support 12 and by a blade attachment 41 to beam support 13. Similarly, blade 31 is secured by blade attachments 42 and 43 to beam supports 12 and 13 respectively and blades 32 and 33 are secured to beam support 12 by blade attachments 44 and 46 respectively and to beam support 13 by blade attachments 45 and 47 respectively. In accordance with an important aspect of the present invention and as is described below in greater detail, hydrofoil blades 30 through 33 define high aspect ratio hydrofoils in which their individual transverse or lateral dimensions are substantially greater than their widths in the flow direction.

Beam support 13 defines a plurality of sockets 51, 53, 55 and 57. Correspondingly and as is better seen in FIG. 4, beam support 12 defines a plurality of sockets 50, 52, 54 and 56. As is set forth below in greater detail, sockets 50 through 57 cooperate with corresponding structures on blades 30 through 33 to form blade attachments 40 through 47 and pivotally secure blades 30 through 83 to beam support 12 and 13 in a limited travel pivotal attachment.

While any number of materials may be used to fabricate swim fin 10 without departing from the spirit and scope of the present invention, in its preferred form swim fin 10 is formed of a resilient semi-rigid molded rubber or plastic material which as set forth below in greater detail includes internal metal or other rigid material reinforcing members. Foot receptacle 11 receives the swimmer's foot such that the swimmer's foot extends into interior cavity 20 with the swimmer's toes situated within toe portion 16 after which strap 14 is drawn about the rear heel portion of the swimmer s foot and firmly clasped by buckle 15. In accordance with conventional swim fin fabrication techniques, strap 14 may include a fin adjustment to accommodate foot size variations. In addition, it should be noted that the axes of beam supports 12 and 13 in their elongated direction are angularly displaced with respect to foot receptacle 11 in a downward direction. This angular displacement is better seen in FIGS. *7a* through *7e* and is intended to compensate for the typical angular relationship between a swimmer's leg and foot due to the restriction of ankle movement. As a result, beam supports 12 and 13 are generally aligned with the swimmer's leg for more efficient stroking action.

In accordance with an important aspect of the present invention and as is set forth below in greater detail, hydrofoil blades 3O through 33 are secured within blade attachments 40 through 47 in a limited travel pivotal attachment in which hydrofoil blades 30 through 33 are pivotally movable about their respective blade attachments within a limited angular motion. While this angular motion is set forth below in greater detail, suffice it to note here that blades 30 through 33 are by means set forth below in greater detail spring biased to assume the position shown in FIG. 1 in which the blades are substantially aligned with the major axis of beam supports 12 and 13. Accordingly, in the absence of stroking motion, this spring biasing force operative upon blades 30 through 33 urges them to the aligned position shown in FIG. 1. In further accordance with an important aspect of the present invention and as is set forth below in greater detail, the pivotal attachments of blades 30 through 33 to beam supports 12 and 13 is positioned forward of the center lines of the hydrofoil blades. Accordingly, motion of the present invention swim fin 10 in either direction causes blades 30 through 33 to be pivoted to the desired angular position with respect to beam supports 12 and 13. While the pivotal action of blades 30 through 33 is set forth below in greater detail, it should be noted that the hydrofoil blades 30 through 33 assume the appropriate angle of attack in response to the hydrodynamic pressure created during the movement of the fin through the water. In accordance with an important aspect of the present invention, the pivotal motion of the hydrofoil blades to the desired angle of attack simultaneously reduces the resistance of the water against fin motion thereby making the stroke easier for the swimmer and concurrently develops a localized area of higher flow velocity and reduced pressure along the front sides of each of the hydrofoil blades. The reduced pressure on the front sides of the hydrofoil blades in turn produces a forward thrust component for increased efficiency of the swim fin. Thus, as is set forth below in greater detail, during each stroke of swim fin 10 the motion of the swim fin through the water aligns blades 30 through 33 at the appropriate angle and the stroke action causes a flow of water across the angled blades which produces a forward thrust carrying the swimmer forward.

FIGS. *2a*, *2b* and *2c* set forth sequential section views of a portion of beam support 13 taken along section lines 2—2 in FIG. 1. At the outset, it should be noted that while FIGS. *2a* through *2c* set forth blade attachment 41 by which one end of blade 30 is secured to beam support 13, the structure shown is representative of the remaining blade attachments of the present invention structure. Accordingly, it should be understood that the descriptions of blade attachment 41 and the surrounding structure thereof which follow serve equally well for blade attachments 40 and 42 through 47 for blades 30 through 33. With respect to FIG. *2a* which shows blade 30 in its centered position, beam support 13 includes an internal reinforcing member 65 preferably formed of a metal or other rigid material surrounded by an outer case 64. Outer case 64 defines a socket 51 having a pair of generally circular travel arcs 62 and 63 and a pair of inwardly extending generally trapezoidal stop members 60 and 61. As can be seen, travel arcs 62 and 63 are positioned on opposing sides of socket 51. Similarly, stop member 60 and 61 are positioned on opposing sides of socket 51. A generally tapered spring slot 73 extends from travel arc 63 of socket 51 in the rearward direction along the major axis of beam support 13. As is better seen in FIG. 3, reinforcing member 65 defines an aperture 66 centered within socket 51. Blade 30, shown in dashed outline form, includes an elongated cylindrical rod 74 (seen in FIG. 3) which terminates in a cylindrical pin 70 which is received within aperture 66 of reinforcing member 65. Blade 30 further defines an elongated web 71 extending from blade 80 and received within socket 51. Web 71 defines a pair of parallel flat surfaces 75 and 76 as well as a rearwardly extending spring tab 72. In accordance with an important aspect of the present invention, spring tab 72 is formed of a generally tapered resilient spring structure and is received within spring slot 73. Pin 70 extends through web 71 and is received within aperture 66.

With temporary reference to FIG. 1, it will be apparent that blade 30 is captivated between blade supports 12 and 13 and is secured therein by the cooperations of blade attachment 41 on one end and blade attachment 40 (seen in FIG. 5) on the other end. Returning to FIG. *2a* which as mentioned depicts the positions of blade 30 and web 71 within socket 51 in the neutral or self-aligning position, blade 30 is shown in the absence of stroking motion of swim fin 10. Accordingly and in accordance with an important aspect of the present invention, the spring force of spring tab 72 within spring slot 73 urges web 71 and thereby blade 30 into the neutral aligned position shown in FIG. *2a*.

FIG. *2b* shows a clockwise rotation of blade 30 about pin 70 which causes a corresponding rotation of web 71. The rotation of web 71 brings spring tab 72 into contact with spring slot 70 causing a deflection or bending of spring tab 72 which produces a spring force urging web 71 toward realignment in the neutral position shown in FIG. *2a*. As web 71 is rotated in the clockwise direction about pin 70, spring tab 72 is forced into contact with the upper surface of spring slot 73. Further clockwise rotation of web 71 causes spring tab 72 to be bent or deflected which, due to spring tab 72's resilience, produces a spring force urging web 71 in the counterclockwise direction. As web 71 is rotated further in the clockwise direction, surface 76 abuts stop 61 and surface 75 abuts stop 60 which precludes further clockwise motion of web 71. Once the pivoting force upon blade 30 is removed, the spring force of tab 72 returns web 71 to the center position shown in FIG. *2a*.

Conversely, FIG. *2c* shows counterclockwise rotation of blade 30 producing a force upon blade 80 in the direction shown by arrow 78. As web 71 is rotated in the counterclockwise direction about pin 70, spring tab 72 is brought into contact with spring slot 73. The continued counterclockwise rotation of web 71 causes spring tab 72 to be deflected producing a spring force which urges web 71 in the clockwise direction toward the aligned position shown in FIG. *2a*. As web 71 continues to rotate in the counterclockwise direction, spring tab 72 is further deflected producing a greater return spring force until surface 75 of web 71 abuts stop 60 and surface 76 abuts stop 61. Stops 60 and 61 preclude further counterclockwise rotation of web 71 which in turn precludes further counterclockwise rotation of blade 30. Once swim fin 10 ceases stroking motion, the force of spring tab 72 urges web 71 and thereby blade 80 in the clockwise direction returning it to the neutral position shown in FIG. *2a*.

Thus, the angular position of blade 30 is rotatable about pin 70 in response to motion of swim fin 10 between the clockwise and counterclockwise extreme positions shown in FIGS. *2b* and *2c* respectively and is returned to the neutral position shown in FIG. *2a* in the absence of stroking motion of swim fin 10.

FIG. 3 sets forth a partially sectioned perspective assembly view of the attachment of blade 80 to beam support 18. Accordingly, as set forth above, beam 18 includes a reinforcing member 65 preferably formed of a rigid material such as metal surrounded by an outer casing 64. Casing 64 in turn defines a socket 51 having a pair of opposed travel arcs 62 and 63 together with a pair of opposed stop members 60 and 61. Reinforcing member 65 defines an aperture 66. Travel arc 63 defines a rearwardly extending spring slot 73. Blade 30 defines an elongated cylindrical pin 74 extending its entire length (see also FIG. 5) and terminating at one end in a pin 70. Blade 30 further defines an outwardly extending web 71 having a rearwardly extending spring tab 72. In the manner described above for FIGS. *2a* through *2c*, blade 30 is pivotally attached to beam support 13 by extending pin 70 into aperture 66 of reinforcing member 65 and aligning web 71 within socket 51 such that spring tab 72 is received within spring slot 73. When so assembled, pin 70 and aperture 66 cooperate to provide a pivotal attachment about which web 71 and thereby blade 30 are rotatable. As is set forth below in connection with FIG. 5, the ends of rod 74 (pins 70 and 80) are expanded or headed by means such as spinning or staking to secure rod 74 in place.

FIG. 4 sets forth a bottom perspective view of swim fin 10. Foot receptacle 11 defines a plurality of reinforcing ribs 17 as well as a tapered internal cavity 20. A strap 14 is secured to foot receptacle 11 by an attachment 18 and extends about internal cavity 20 as described above. As is also described above, foot receptacle 11 further includes a pair of outwardly extending lateral supports 21 and 22 which in turn support a pair of beam supports 12 and 13 respectively. Beam support 12 defines a plurality of sockets 50, 52, 54 and 56 which cooperate to form blade attachments 40, 42, 44 and 46 respectively for blades 30, 31, 32 and 33 respectively. As is set forth above, beam support 13 defines a plurality of blade attachments 41, 43, 45 and 47 (better seen in FIG. 1). As is also described above, blades 30 through 33 are pivotally supported between beam supports 12 and 13 by blade attachments 40 through 47.

FIG. 5 sets forth a partial section view of blade attachment 40 which as mentioned above is substantially identical to blade attachment 41 set forth in FIGS. 2 and 3 above. Accordingly, blade 30 includes an elongated cylindrical rod 74 terminating in an outwardly extending pin 80. Blade 30 further defines an elongated web 81 having a pair of flat opposed surfaces 85 and 86 on either side of pin 80. Web 81 further defines a rearwardly extending resilient spring tab 82. To permit spring tab 82 to flex and provide a spring force, it is spaced from blade 30 by a space 84 and is joined solely to web 81. It should be noted that the structure of pin 80 and web 81 is substantially identical to the structures of pin 70 and web 71 set forth above for blade attachment 41. By way of further similarity, beam support 12 defines an elongated rigid reinforcing member 90 having an aperture 87 formed therein and a surrounding outer case 91. Case 91 further defines a socket 50 having a pair of opposed travel arcs 96 and 97 and a pair of inwardly extending opposed stop members 94 and 95. Socket 50 further defines a rearwardly extending spring slot 93. Socket 50 is substantially identical to socket 51 set forth above. Case 91 of beam support 12 further defines a counter bore 88 concentric with aperture 87. The assembly of blade 30 to beam support member 12 is carried forward by extending pin 80 into and through aperture 87 and causing web 81 to be aligned with respect to socket 50 such that spring tab 82 is aligned with spring slot 93. Thereafter, web 81 is received within socket 50 in the same manner described above for the positioning of web 71 within socket 51. Thereafter, pin 80 is expanded to extend beyond aperture 87 within counter bore 88 by spinning or staking operation or the like.

With simultaneous reference to FIGS. 1, 3, 4 and 5, it will be apparent to those skilled in the art that blade 30 is captivated between beam supports 12 and 13 by the extensions of pins 70 and 80 into apertures 66 and 87 respectively within reinforcing members 65 and 90 respectively. It will be further apparent that web 71 is received within socket 51 and web 81 is received within socket 50. The cooperative structure thus formed captivates blade 30 between beam supports 12 and 13 in pivotal attachment. As will be apparent from examination of FIG. 5, the cooperation of web 81 and spring tab 82 within socket 51 and spring slot 93 provides a limited pivotal travel motion for web 81 within socket 50 in the same manner described above for web 71 within socket 51. Accordingly, both ends of blade 30 are subjected to the above-described pivotal travel limitations. Similarly, blades 31, 32 and 33 are pivotally secured between beam supports 12 and 13 in the identical manner to that described for beam 30.

FIG. 6 sets forth an alternate embodiment of the pivotal attachment of the hydrofoil blades to the beam supports of the present invention swim fin. Accordingly, a beam support 103 which includes an outer casing 105 and a reinforcing member 104 should be understood to generally correspond to beam supports 12 and 13 with the exception of beam attachments 41 through 47. Similarly, a hydrofoil blade 101 should be understood to be substantially identical to blades 30 through 33 set forth above with the exception of its attachment to beam support 103. Accordingly, blade 101 includes an elongated rod 100 which in contrast to rod 74 of blade 30 is entirely internal of blade 101 such that end 107 of rod 100 is included within blade 101 and does not extend beyond the blade. Similarly, outer casing 105 does not define a socket in the manner set forth above for beam supports 12 and 13. In contrast to the above-described embodiments, the embodiment of FIG. 6 relies upon a resilient hinge 102 which extends across space 106 between blade 101 and outer casing 105 of beam support 103. In its preferred form, blade 101, outer casing 105 and resilient hinge 102 are formed of a common molded resilient material. Accordingly, during the above-described stroking motion for swim fin 10, the force upon blade 100 causes blade 100 to pivot about resilient hinge 102. Due to the resilient structure of hinge 102 and its integral attachment to blade 101 and outer casing 105, the pivotal motion of blade 101 produces a resisting elastic torque in resilient hinge 102 which opposes the pivotal motion of blade 101. Accordingly, during stroking motions, the resilient force of hinge 102 is overcome and blade 101 is pivoted in much the same manner as described for the above embodiment. In the absence of stroking motion, however, the resilient spring force of hinge 102 restores blade 101 to a neutral or aligned position corresponding to the neutral position for blade 30 shown in FIG. *2a*. In all other respects, the embodiment depicted in FIG. 6 is identical to and functions in the same manner as the above-described embodiment.

FIGS. *7a* through *7e* set forth the sequential operation of swim fin 10 during a typical swimming stroke. It should be noted that the depiction of swim fin 10 is simplified in FIGS. *7a* through *7e* to better describe and set forth the operation of hydrofoil blades 30 during a swimming stroke. Accordingly, a typical swimmer's leg 110 having a hip joint 111, a knee joint 112, an ankle joint 113 and a foot 114 is set forth in FIGS. *7a* through *7e*. Similarly, foot 114 is received within foot receptacle 11 of swim fin 10 and is secured therein by strap 14.

With respect to FIG. *7a*, leg 110 is shown in the center position corresponding to a straight line relationship to the swimmer's body and the center point between upward and downward swimming strokes. It should be noted that foot receptacle 11 and foot 114 define a plane 116 which due to the limitations of motion of ankle 113 is angularly displaced from a straight line relationship with leg 110. Accordingly and in accordance with an important aspect of the present invention, beam support 12 as well as beam support 18 (not seen) define a plane which is angularly displaced from plane 116 by an angle 117. The angle selected for displacement of beam supports 12 and 13 from foot plane 116 is selected to compensate for the limited angular movement obtainable by ankle 113. The objective is to place beam supports 12 and 13 in general alignment with leg 110 for maximum efficiency. From the position shown in FIG. *7a*, it should be noted that in accordance with the above-described spring biasing forces applied to blades 30 through 33, the hydrofoil blades are in general alignment with beam support 12. Thus, prior to the initiation of a swimming stroke, blades 30 through 33 are essentially centered. With the motion of leg 110 about hip 111 in the downward direction indicated by arrow 115, leg 110 begins to pivot about hip 111 causing swim fin 10 to be moved downwardly in the direction indicated by arrow 120. In accordance with the foregoing described pivotal support of blades 30 through 33, the downward motion of swim fin 10 causes blades 30 through 33 to pivot about their respective pivotal supports and assume the angular positions shown in FIG. *7b*. As swim fin 10 is driven downwardly from the position shown in FIG. *7b* to the position shown in FIG. *7c*, the movement of swim fin 10 through the water forces blades 30 through 33 downwardly through the water causing a flow of water around the blade surfaces. Because of the foregoing described pivotal limit on the pivotal motions of blades 30 through 33. The appropriate angular relationship or angle of attack is established between the hydrofoil blades and the water passing through the structure of swim fin 10 to provide a hydrofoil action. It should be noted that because of the spacing between blades 30 through 33, water passes between the angled blades which substantially minimizes the energy required to move swim fin 10 through the water during the swimming stroke. As a result, a substantial saving in energy on the part of the swimmer is realized. In addition, because of the established angle of attack between blades 30 through 33, the water flowing about the forward surfaces of the hydrofoil blades travels at a significantly greater velocity than the water traveling about the rearward surfaces of the hydrofoil blades. Accordingly, the higher velocity flow about the front blade surfaces produces a localized reduced pressure on the front surfaces of hydrofoil blades 30 through 31 which in turn produces a forward thrust in the direction indicated by arrow 130. FIGS. *7c* and *7d* show the continuation of the downward stroke due to the pivotal motion of leg 110 about hip 111. Accordingly, a downward motion of swim fin 10 in the directions indicated by arrows 121 and 122 respectively causes a continued movement in the downward direction of swim fin 10. The continued downward movement of swim fin 10 maintains the flow of water through the structure of swim fin 10 and maintains the angular position of hydrofoil blades 30 through 33. In accordance with the above-described pivotal attachment of blades 30 through 33 and in accordance with an important aspect of the present invention, the appropriate angle of attack for blades 30 through 33 is maintained during the entire downward stroke. Correspondingly, the above-described hydrofoil effect continues as water flows through the structure of swim fin 10 and around blades 30 through 33. Thus, the forward thrust in the direction of arrow 130 continues during virtually the entire downward stroke.

In FIG. *7e* the swimmer has terminated the downward portion of the swimming stroke and initiated an upward direction stroke as indicated by arrow 123. With the switch in the direction of motion of swim fin 10 resulting from the upward kicking stroke, the force upon hydrofoil blades 30 through 33 is reversed causing the hydrofoil blades to pivot to the opposite positions shown in FIG. *7e*. As swim fin 10 is moved upwardly in the direction indicated by arrow 123, the angle of attack of blades 30 through 33 is reversed and properly oriented with respect to the movement of water about the hydrofoil blades to provide the above-described hydrofoil action producing a forward thrust in the direction indicated by arrow 130. As the upward kicking stroke is continued, hydrofoil blades 30 through 33 maintain the angular positions shown in FIG. *7e* and the forward thrust is produced during the entire upward stroke.

What has been shown is an improved more efficient swim fin which provides for greater ease of movement through the water and which provides an increase in swim fin efficiency through the use of a plurality of high aspect ratio hydrofoil blades.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use in aiding a swimmer or diver, a swim fin comprising:

foot attachment means;

a pair of elongated support beams secured to and extending from said foot attachment means;

a plurality of hydrofoil blades each defining a length, a leading edge, a trailing edge and opposed hydrofoil curved surfaces therebetween wherein said hydrofoil blades each define lengths substantially greater than the distance from their leading edges and trailing edges;

pivotal attachment means coupling said hydrofoil blades to said support beams in a pivotal attachment in which said hydrofoil blades are pivotal through a limited angular range, said pivotal attachment means including spring means operative upon each of said hydrofoil blades biasing said hydrofoil blades to a neutral position in alignment with said elongated beam supports and including pairs of pins extending from said hydrofoil blades defining an axis of rotation therebetween and wherein said axis of rotation is closer to said leading edge than said trailing edge; and said hydrofoil blades each defining a center of force and wherein said pivotal attachment means are coupled to each of said hydrofoil blades at points offset from said center of force.

2. A swim fin as set forth in claim 1 wherein said pivotal attachment means include a plurality of sockets defined in said beam supports each having limit stops and an elongated web extending from said hydrofoil blades received within said sockets, said webs abutting said limit stops to restrict the pivotal motion of said hydrofoil blades to a predetermined angular travel.

3. A swim fin as set forth in claim 2 wherein each of said sockets defined spring slots extending therefrom and wherein said spring means each include a resilient spring member extending from each of said webs into a respective spring slot.

4. For use on a swimmer's foot, a swim fin comprising:

a foot receptacle having means for attachment to a swimmer's foot;

a pair of lateral members extending outwardly from said foot receptacle;

a pair of beam members joined to said lateral supports and extending therefrom in a parallel relationship;

a plurality of hydrofoil blades;

means pivotally securing said hydrofoil blades to said beam members such that said hydrofoil blades extend between said beam supports;

spring means operative on each of said hydrofoil blades biasing said hydrofoil blades to a neutral position in alignment with said beam members; and limit means operative upon said hydrofoil blades to restrict the angular range of said pivotal securing.

5. A swim fin as set forth in claim 4 wherein said spring means include a plurality of resilient tabs joined to said hydrofoil blades and a cooperating plurality of notches defined in said beam members receiving said tabs, said spring means being operative upon said hydrofoil blades to bias them to a common plane of alignment.

6. For use on a swimmer's foot, a swim fin comprising:

a foot receptacle having means for attachment to a swimmer's foot;

a pair of lateral members extending outwardly from said foot receptacle;

a pair of beam members joined to said lateral supports and extending therefrom in a parallel relationship.

a plurality of hydrofoil blades each having a foil portion and two ends; and hinge means including a pair of resilient hinges pivotally securing said ends of hydrofoil blades to said beam supports such that said hydrofoil blades are resiliently suspended between said beam members and biased to a neutral alignment with said beam members.

* * * * *